US006370778B1

(12) United States Patent
Conable

(10) Patent No.: US 6,370,778 B1
(45) Date of Patent: Apr. 16, 2002

(54) LOCKING FOLDING KNIFE

(76) Inventor: Matthew W. Conable, 595 Hillcrest Dr., Felton, CA (US) 95018

( * ) Notice: Subject to any disclaimer, the term of this patent is extended or adjusted under 35 U.S.C. 154(b) by 0 days.

(21) Appl. No.: 09/736,730

(22) Filed: Dec. 13, 2000

(51) Int. Cl.[7] ..... B26B 1/04
(52) U.S. Cl. ..... 30/161; 30/160
(58) Field of Search ..... 30/155, 158, 160, 30/161

(56) References Cited

U.S. PATENT DOCUMENTS

| | | | | |
|---|---|---|---|---|
| 1,603,914 A | | 10/1926 | Hermann | |
| 2,596,294 A | | 5/1952 | Schrade | 30/161 |
| 4,502,221 A | | 3/1985 | Pittman | 30/160 |
| 4,719,700 A | | 1/1988 | Taylor, Jr. | 30/158 |
| 4,811,486 A | | 3/1989 | Cunningham | 30/161 |
| 5,095,624 A | | 3/1992 | Ennis | 30/161 |
| 5,685,079 A | | 11/1997 | Brothers et al. | 30/161 |
| 5,692,304 A | | 12/1997 | Campbell | 30/161 |
| 5,737,841 A | * | 4/1998 | McHenry et al. | 30/161 |
| 5,755,035 A | * | 5/1998 | Weatherly | 30/161 |
| 5,769,094 A | | 6/1998 | Jenkins, Jr. et al. | 30/161 |
| 5,915,792 A | | 6/1999 | Sakurai | 30/161 |

FOREIGN PATENT DOCUMENTS

| | | | | |
|---|---|---|---|---|
| FR | 1042065 | * 10/1953 | | 30/161 |
| GB | 740133 | * 11/1995 | | 30/161 |

* cited by examiner

*Primary Examiner*—Hwei-Slu Payer
(74) *Attorney, Agent, or Firm*—Thomas W. Epting; Leatherwood Walker Todd & Mann, P.C.

(57) ABSTRACT

A folding knife having a handle and a blade attached to the handle, the blade being connected for movement between a retracted position and an extended position with respect to the handle, and the blade a first locking profile, such as a notch. A locking member is provided having a second locking member, such as a projection, the projection being configured to be engageable with the notch when the blade is in the extended position. A pivotal connector is connected to the handle and to the locking member for allowing the locking member to pivot with respect to the handle. The locking member is movable between a locking position, wherein the second locking profile is in locking engagement with the first locking profile for locking the blade in the extended position, and an unlocking position, wherein the blade is movable with respect to the handle. A spring is connected to the handle and to the locking member, between the second locking profile and the pivotal connector, for pulling the projection into locking engagement with the notch when the blade is in the extended position.

23 Claims, 5 Drawing Sheets

Fig. 4A
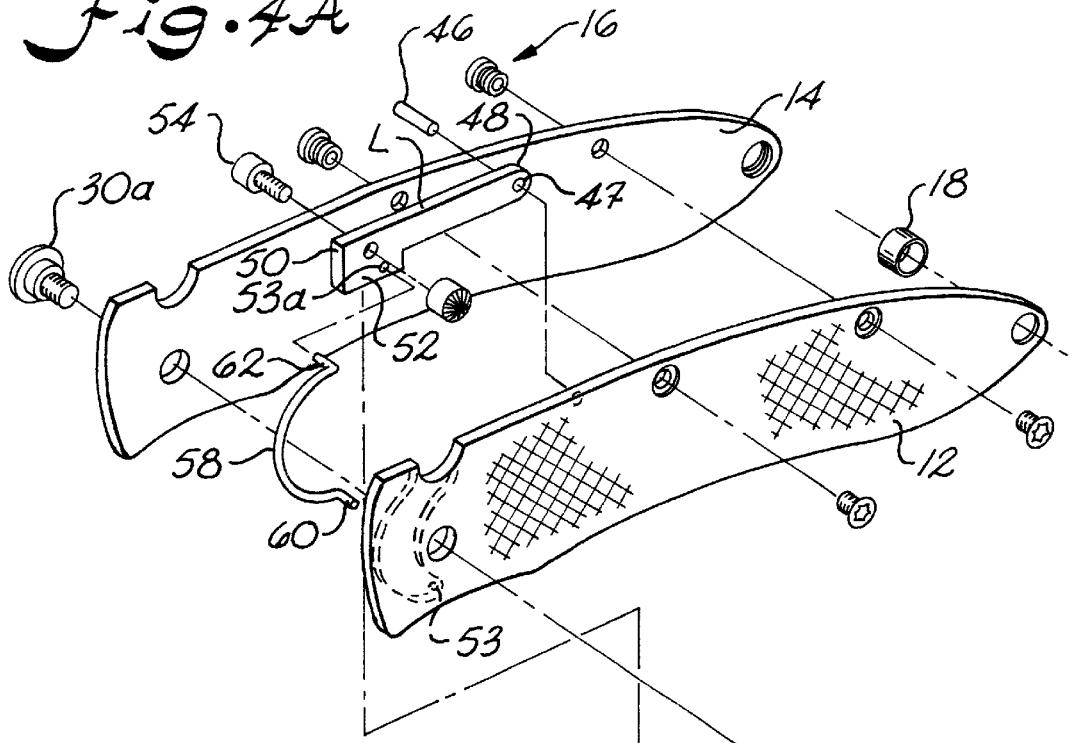
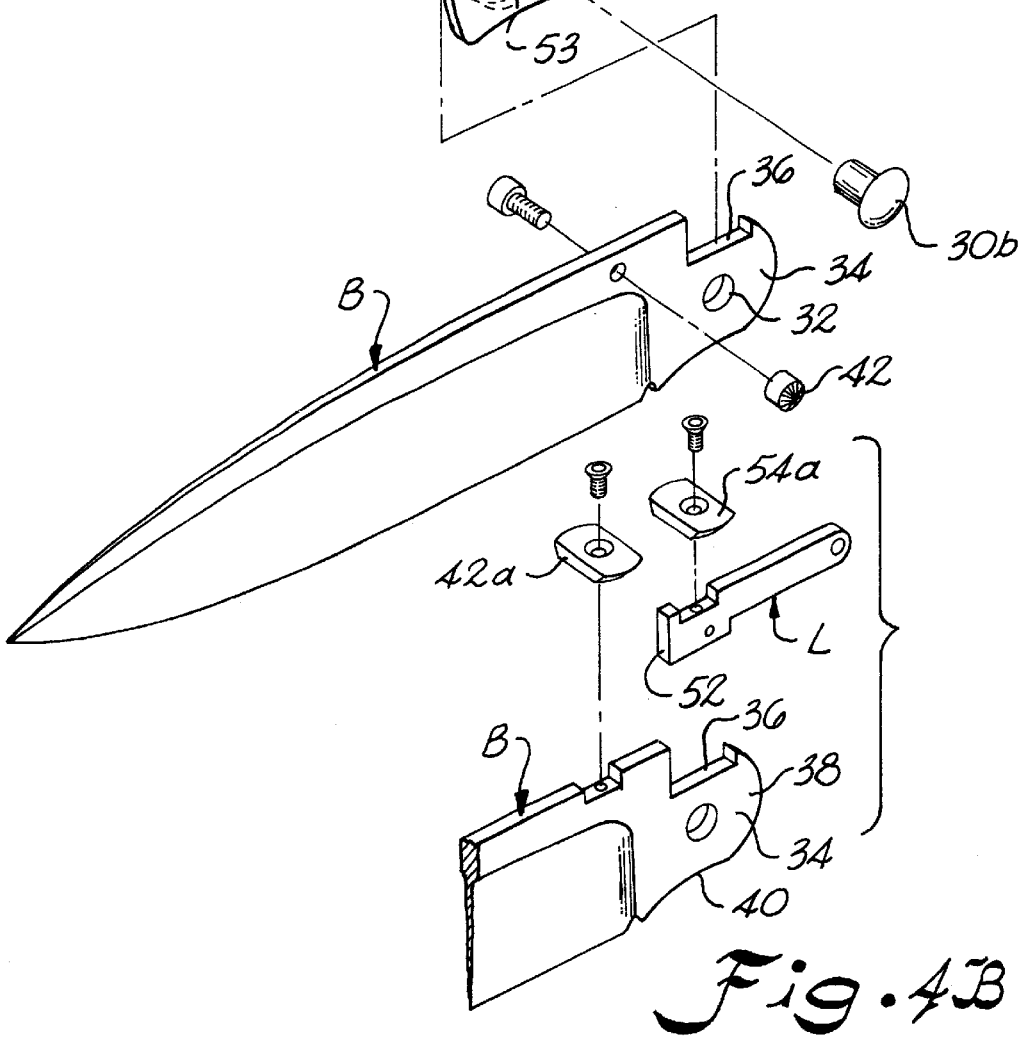
Fig. 4B

LOCKING FOLDING KNIFE

BACKGROUND OF THE INVENTION

This invention relates generally to a folding knife having a blade which automatically becomes locked once it is moved to an extended position. Fixed blade knives such as sheath knives, are effective cutting instruments, but because of their overall length, they present problems for transport purposes when space is limited. Folding knives address this problem by providing a handle portion with a retractable blade. Folding knives are a popular means for allowing a blade to be conveniently carried by a user, such as in the user's pocket, toolbox, glove compartment, backpack, etc. Certain folding knives have a blade which may be automatically locked in an open position and then manually unlocked when the blade is to be closed back into the knife's handle. Folding knives which have a blade which pivots outwardly from the handle and which automatically locks once in the extended position are desirable for safety purposes, since the blade is prevented from closing on the user's hand or fingers while the user grasps the handle of the knife during use.

Conventional locking means for automatically locking a pivoting blade of a folding knife in the extended position have included an elongated lock bar pivotally connected to the backside of the knife's handle. An elongated spring, such as a piano wire-type spring, may be used to urge upwardly on the rearward portion of the lock bar to force a locking tab provided on the forward portion of the locking bar into engagement with a notch provided in the tang of the blade. The notch in the tang is presented to the locking tab when the blade is in the extended position. In this type of knife, the locking bar is depressed, rearwardly of its pivot point in the back of the handle, by the user using one hand, against the upward force bearing on the lock bar by the spring, in order to raise the locking tab out of engagement with the notch in the tang. By simultaneously depressing the locking bar in the manner, the user with his or her other hand would then pivot the blade to the retracted position within the knife's handle.

Potential disadvantages of this locking bar arrangement include the sheer size of the locking bar, which generally extends the length of a major portion of the handle, and also the weight added to the knife by the locking bar. Further, the spring wire, or "backspring," takes up additional space, which therefore reduces the space allowed for the blade, and, accordingly, becomes a limiting factor for blade size.

Also, because the lock bar must be depressed rearwardly of its pivot point in order to unlock the blade, a recess or relief is generally required in the backside of the knife's handle in order to allow the user's thumb to depress the lock bar downwardly within the handle. This necessity of a recess adds another design requirement for the knife and also could provide an opportunity for the user to inadvertently depress the lock bar, such as by squeezing the handle too tightly or in an awkward manner, during use of the knife, which could, in turn, cause the blade to become unlocked during use. Obviously, this could pose safety concerns.

Various folding knives have been patented. For example, U.S. Pat. No. 1,603,914, issued to Hermann, discloses a spring structure connected to the tang of a blade which is used to open the blade. U.S. Pat. No. 4,502,221, issued to Pittman, discloses a locking knife having a release which is pulled upwardly in order to retract the blade. U.S. Pat. No. 5,692,304, issued to Campbell; U.S. Pat. No. 5,685,079, issued to Brothers, et al; and U.S. Pat. No. 4,811,486, issued to Cunningham, disclose locking folding knives having an engagement tab at the top of the handle for engaging a locking notch within the tang of the blade.

U.S. Pat. No. 5,095,624, issued to Ennis, discloses a folding knife having a pivotal toggle mounted for engaging a pin in the blade handle. The toggle is maintained in its locked position by a coil spring mounted in an elongated bore formed in the knife handle.

Accordingly, even in view of the foregoing designs, there still exists a need for an improved folding knife having a blade which automatically locks when moved to the extended position and which can be unlocked with the use of only one hand. A need also exists for a simplified locking mechanism of less weight than prior designs.

SUMMARY OF THE INVENTION

It is, therefore, the principal object of this invention to provide a folding knife having an improved blade locking mechanism.

It is another object of the present invention to provide a folding knife having a blade which becomes automatically locked upon the blade being moved to an extended position and which can be unlocked by the user using only one hand.

Another object of the present invention is to provide a folding knife having a blade locking mechanism with improved means for preventing the blade from becoming inadvertently unlocked.

Yet another object of the present invention is to provide a locking folding knife having a locking mechanism of reduced weight.

Still another object of the present invention is to provide a folding knife having a blade locking mechanism of lower profile, or smaller size, which thus allows for a larger blade to be used in the folding knife.

Another object of the present invention is to provide a folding knife having an improved mechanism for maintaining the blade of the knife in the retracted position.

It is another object of the present invention to provide a method of assembling a folding knife and a method of automatically locking a blade thereof upon the blade being moved to an extended position.

Generally, the present invention attempts to address the foregoing objects by providing a folding knife having an elongated handle with a forward end and a rearward end. A blade is attached to the handle, the blade being connected for movement between a retracted position and an extended position with respect to the handle, and the blade defining a tang portion and a first locking profile, such as a projection or a notch.

A locking member is provided having a second locking profile, such as projection (if the first locking profile is a notch) or a notch (if the first locking profile is a projection), the second locking profile being configured to be engageable with the first locking profile when the blade is in the extended position.

A pivotal connector is connected to the handle and to the locking member and allows the locking member to pivot with respect to the handle. The locking member is movable between a locking position, wherein the second locking profile is in locking engagement with the first locking profile for locking the blade in the extended position, and an unlocking position, wherein the blade is movable with respect to the handle.

A spring is connected to the handle and to the locking member, between the second locking profile and the pivotal connector, for urging the second locking profile towards the first locking profile when the blade is in the extended position.

More specifically, the present invention includes the locking member being a bar having a locking projection at one end thereof and the pivotal connector at the other end thereof. The spring, in one preferred embodiment, is a curved wire spring placed in tension, and in another preferred embodiment, a coil spring placed in tension, for pulling the bar towards the blade. Also in a preferred embodiment, the notch is defined in the blade adjacent the tang of the blade.

The present invention also includes a method of constructing the locking folding knife of the present invention and for automatically locking the blade upon the blade being moved to the extended position.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which:

FIG. 4A is an exploded view of a locking folding knife constructed in accordance with the present invention;

FIG. 4B is a partial exploded view of an alternate embodiment of a locking folding knife constructed in accordance with the present invention;

DESCRIPTION OF THE PREFERRED EMBODIMENT

Figure 1:
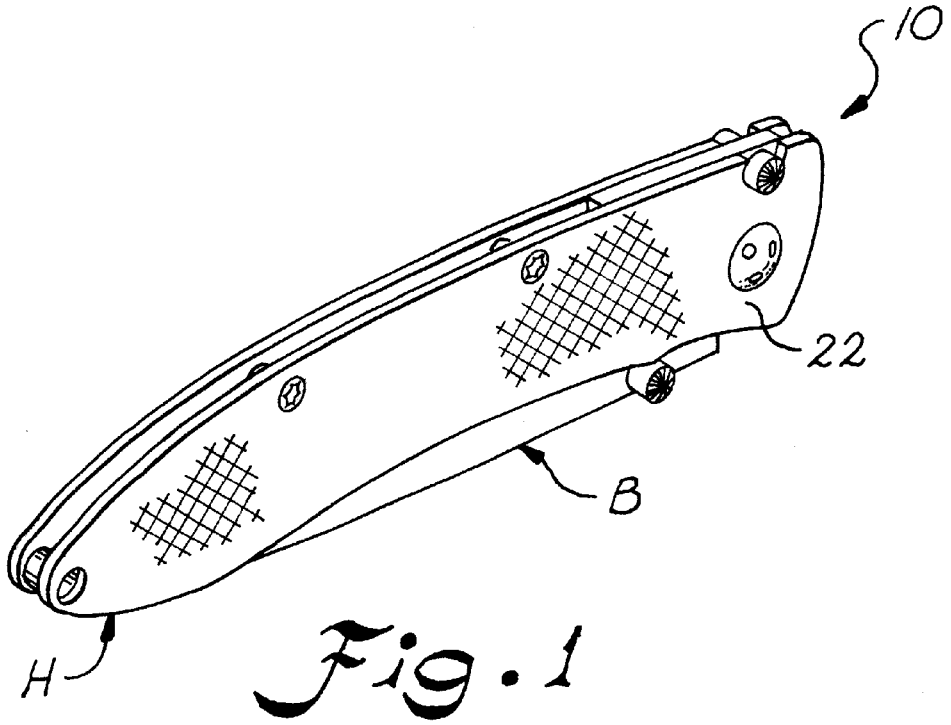
FIG. 1 is a perspective view of a locking folding knife constructed in accordance with the present invention, with the blade in a retracted position.

The accompanying drawings and the description which follows set forth this invention in its preferred embodiment. However, it is contemplated that persons generally familiar with folding knives will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the assembly, construction, and method of use of the locking folding knife of the present invention is discussed in detail, and the locking folding knife is indicated generally in the figures by reference character 10.

Figure 2:
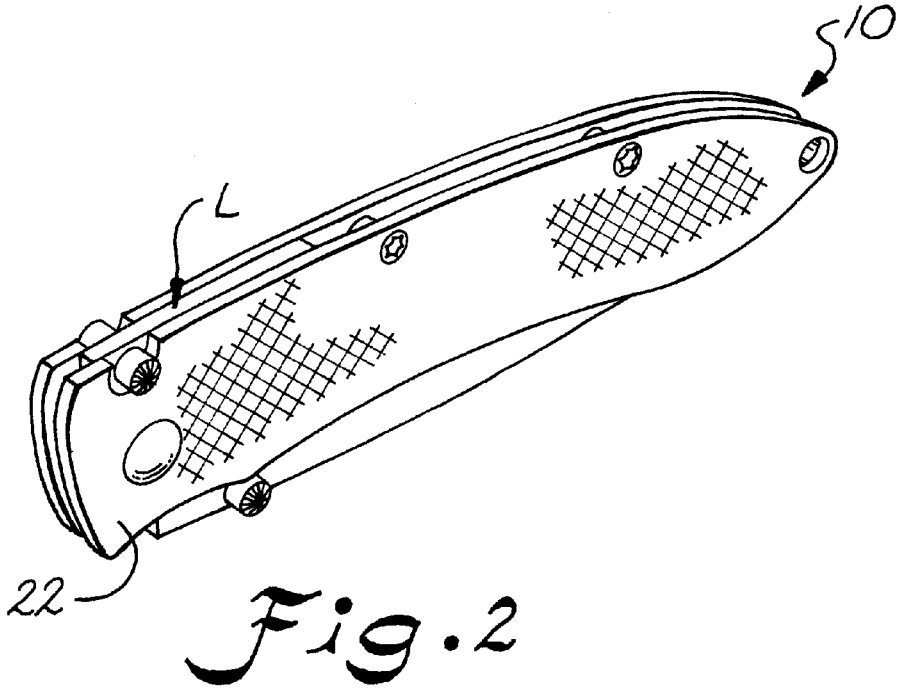
FIG. 2 is a perspective view of the locking folding knife shown in FIG. 1, from a different angle.
Figure 3:
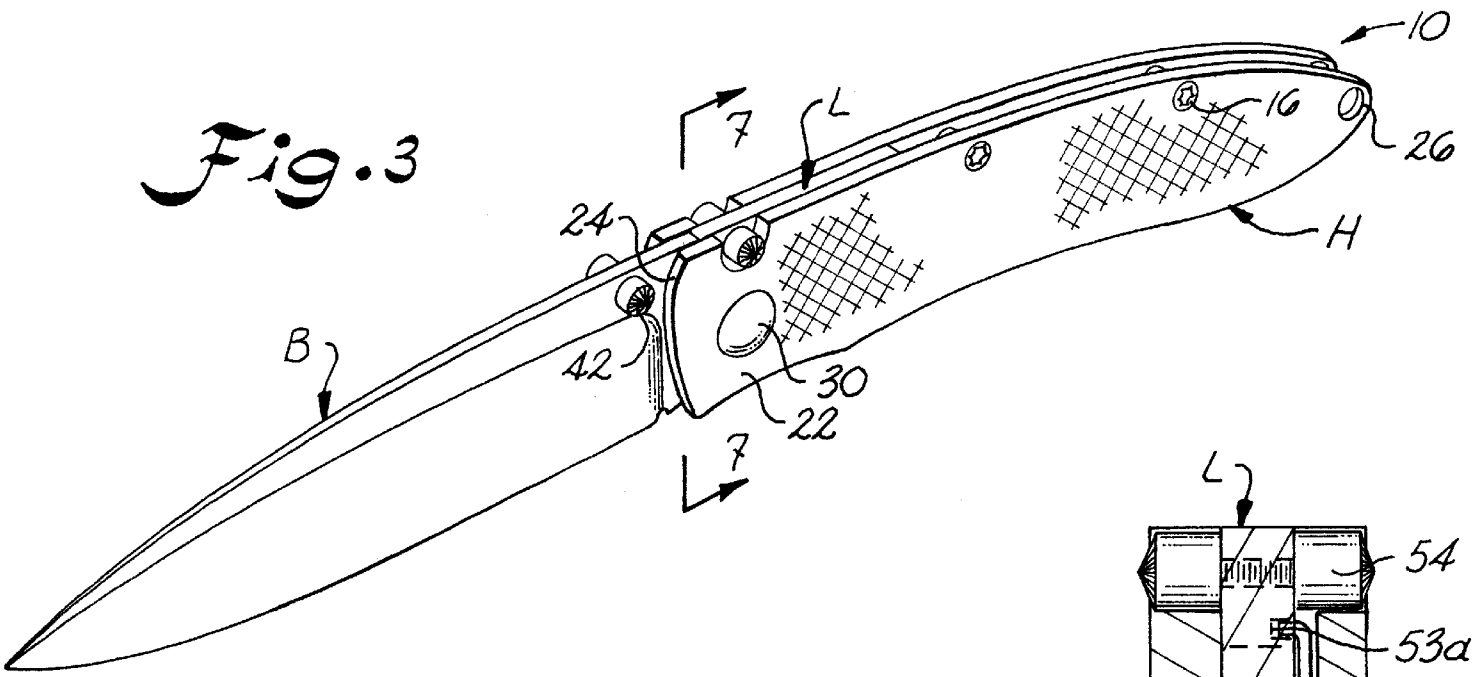
FIG. 3 is a perspective view of a locking folding knife constructed in accordance with the present invention, with the blade in an extended position.
Figure 7:
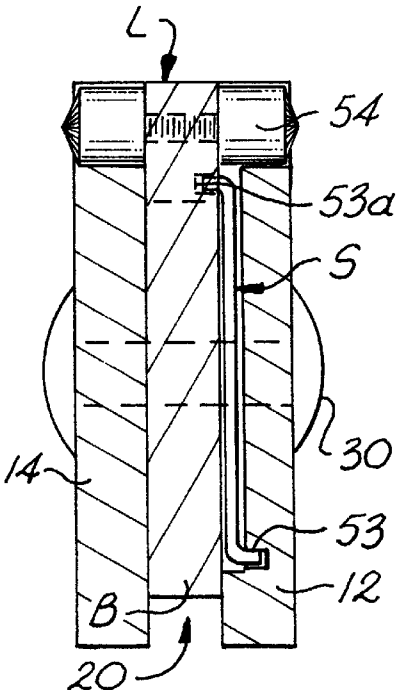
FIG. 7 is a sectional view taken along lines 7—7 of FIG. 3.

Turning to FIGS. 1 and 2, locking folding knife 10 of the present invention is illustrated having a handle, generally H, and a blade, generally B, in a retracted position. FIG. 3 illustrates blade B in an extended position.

Handle H, as shown in FIG. 4A, includes two opposed exterior grip members, generally 12, 14, which are attached together using screw combinations, generally 16. A spacer 18 is used to separate grip members 12, 14, and together with the thickness of blade B provide a blade cavity 20 between grip members 12, 14. It is to be understood, however, that handle H could be of unitary construction, and could be molded of plastic, glass-filled nylon, etc., or could be made of wood, bone, or some other suitable material. In one preferred embodiment, grip members 12, 14 are constructed of plastic, graphite-reinforced polymer, or some other suitable material. Handle H includes a forward portion, generally 22, and a forward end 24 and a rearward end 26 opposite forward end 24.

Blade B is preferably made of cutlery steel (although other suitable blade materials could be used) and is connected to handle H with a pivotal blade connector, such as axle or pin 30. Pin 30 has two pieces, one of which is a male threaded portion 30*a* and the other is a female threaded portion 30*b* which are received by a bore 32 within the tang 34 of blade B.

Figure 6:
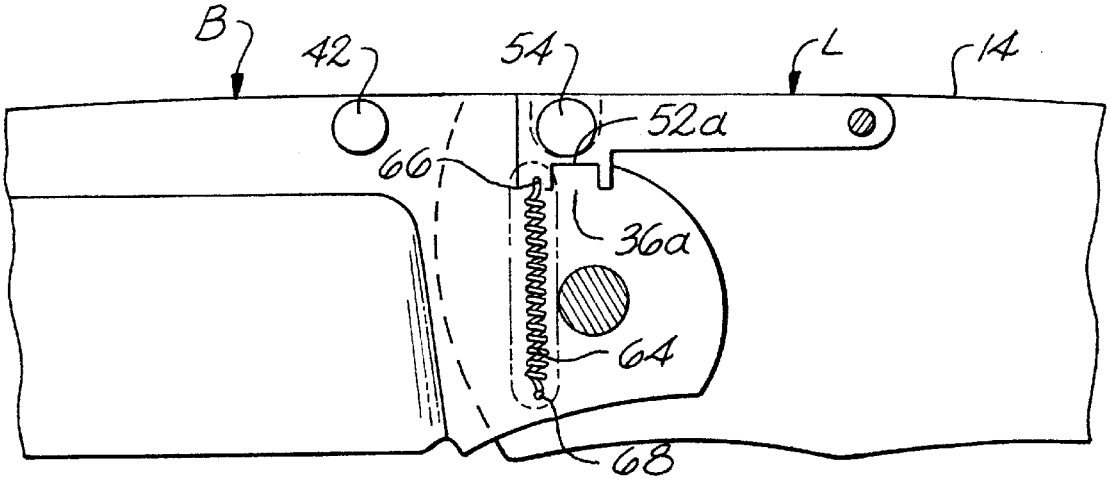
FIG. 6 is a partial side elevational view, with parts cut away, of an alternate embodiment of a locking folding knife constructed in accordance with the present invention.

Blade B also includes a first locking profile, such as an aperture or notch 36 (or a projection 36*a*, as shown in FIG. 6) in tang portion 34 of blade B. Tang portion 34 also defines a guide profile, generally 38, which is of a generally semicircular profile and extends from adjacent notch 36 to a retention profile 40, which in one preferred embodiment, is of a shallow, concave profile defined in the blade.

Blade B may also include one or more projections, such as fixed or fully rotatable knobs 42 or tabs 42*a* (FIG. 4B) for the user to engage when moving blade B from the retracted position to the extended position, or vice versa. By engaging knobs 42 using the thumb or fingers, the user may open blade B to the extended position using only one hand.

Figure 5A:
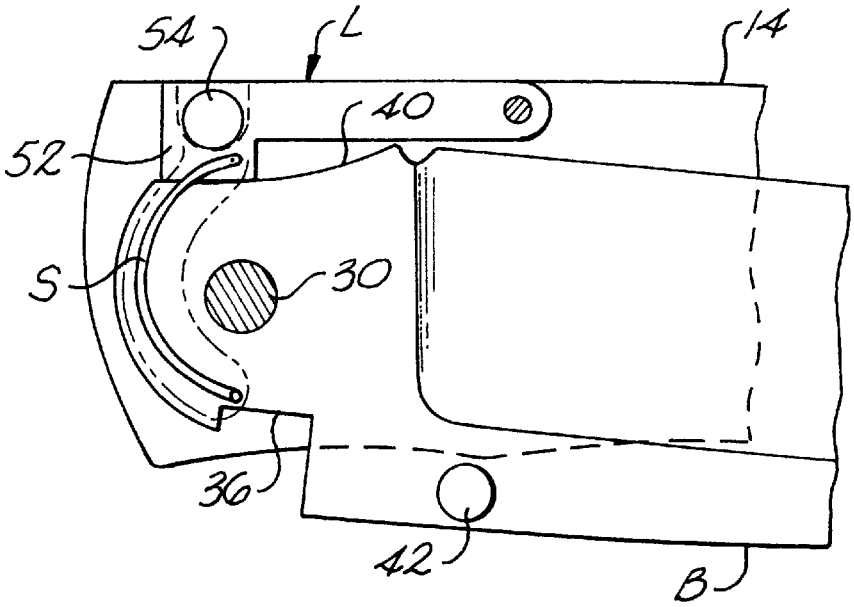
FIG. 5A is a partial side elevational view, with parts cut away, of the locking folding knife illustrated in FIG. 1, with the blade being in a closed, or retracted, position.

As shown in FIG. 4A, locking member, or bar, L is connected to handle H through a pivotal connector 46 received in bore 47 in locking member L. In one preferred embodiment, the pivotal connector 46 is positioned adjacent one end 48 of locking member L, and at the other end 50 of locking member L, a second locking profile, such as a downwardly-extending tab 52 (or a notch or aperture 52*a* as shown in FIG. 6), is provided for cooperating with the first locking profile, namely, notch 36. As shown in FIG. 5, when blade B is in the extended position, tab 52 is received in notch 36 and engages blade B in a manner to lock blade B in the extended position.

It is to be understood that the first and second locking profiles could be of a variety of different cooperating configurations, only several of which are shown in the drawings. For example, although not shown, the locking profiles could be a pin and ring or hole configuration, wherein the pin is received in the ring or hole to lock the blade, or other known variations could be used.

Locking member L moves into the blade locking position automatically upon blade B being moved to the extended position by virtue of a spring, generally S, which is connected to both handle H (in bore 53) and locking member L (in bore 53*a*) and which pulls downwardly on locking member L to urge locking tab 52 into engagement with notch 36 of blade B when blade B is moved to the extended position.

In order to move blade B to the retracted position, the user would raise end 50 of locking member L using post members 54 or tabs 54*a* (FIG. 4B) to lift end 50 of locking member L upwardly a sufficient distance such that locking tab 52 no longer extends into notch 36 of blade B. The user can raise locking member L in this manner with his or her thumb and then, still using only one hand, simultaneously pivot blade B to the retracted position with one or more of the user's fingers on the same hand. Accordingly, locking folding knife 10 of the present invention can be opened by moving blade B from the retracted position to the extended position, automatically locked in the extended position, and unlocked and returned to the retracted position, all with the user using a single hand.

Figure 5B:
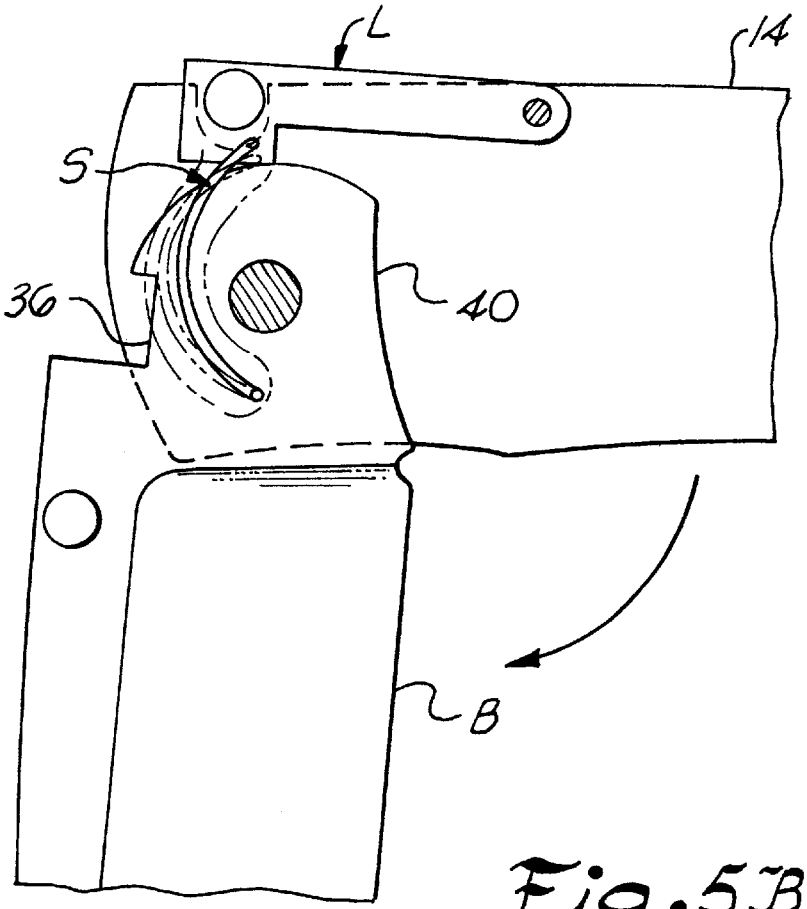
FIG. 5B is a partial side elevational view, with parts cut away, of the locking folding knife shown in FIG. 5A, with the blade at an intermediate position between the retracted and extended positions.
Figure 5C:
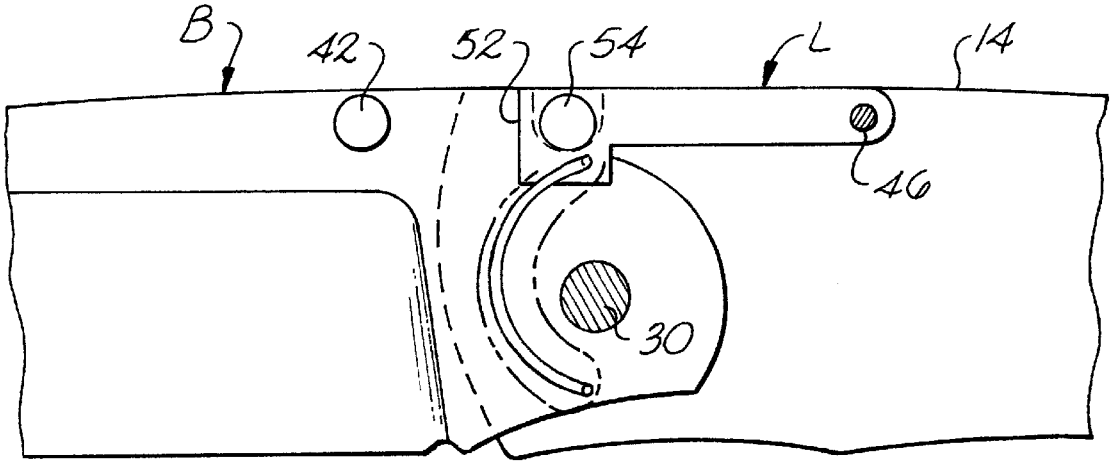
FIG. 5C is a partial side elevational view, with parts cut away, of the locking folding knife illustrated in FIGS. 5A and 5B, with the blade in the extended position and locked with a locking tab being received in the notch of the tang of the blade.

As blade B moves from the retracted position (FIG. 5A) to the extended position (FIGS. 5C and 6), locking tab 52 of locking member L bears upon guide profile 38 of tang 34, as shown in FIG. 5B, to provide resistance to the closing of blade B to the retracted position. This allows for more control of the blade B as it is closed by the user, as there is some resistance during closure, and enhances the safe operation of the knife 10.

As blade B is moved to the retracted position, locking tab 52 then rides upon retention profile 40, as shown in FIG. 5A, and because of the slight concavity of retention profile 40, blade B is retained in the retracted position due to the spring force applied on locking member L, and accordingly on locking tab 52, against retention profile 40. It is to be understood that upon locking member L being raised in a sufficient manner such that locking tab 52 clears notch 36, during closure of the blade, and blade B pivoted slightly such that upon release of locking member L, locking member L now rides upon guide profile 38, the spring force provided by spring S provides a consistent force upon locking member L, and in turn, upon guide profile 38.

As shown in FIGS. 4A, 5A–5C, and 7, spring S can be a wire spring 58, of a generally semi-circular profile and having legs 60, 62 (FIGS. 4A and 7) for engagement with handle H in locking member L, respectively. A significant feature of knife 10 is the fact that spring S is attached to locking member L forward of pivotal connector 46 in order to provide a constant pulling, or downward force, on locking member L, and accordingly, on locking tab 52 thereof. Although not shown, a compression spring could be provided for pressing downwardly on locking member L, again forward of pivotal connector 46, in order to urge locking tab 52 downward. Alternately, although also not shown, the second locking profile, such as tab 52, of locking member L could be positioned between pivotal connector 46 and the point of connection of spring S with locking member L. This arrangement would still provide a downward spring force on locking member L against tang 34.

In a preferred embodiment, spring S is connected to handle H in a forward portion thereof, between pivotal blade connector 30 and the extreme forward end of handle H. In this manner, spring S always maintains a firm pull on locking bar L to ensure a secure locking together of the locking profiles on the locking bar L and the blade B.

Spring S is shown in the preferred embodiment as being a tension spring, such as wire spring 58 discussed above, or, as shown in FIG. 6, spring S could be a coil spring 64 having ends 66, 68 connected to locking member L and handle H respectively.

From the foregoing, it can be seen that the present invention provides a folding knife having an improved blade locking mechanism. Blade B becomes automatically locked upon being moved to the extended position through engagement of locking bar L, acting under the biasing of spring S, with, a locking profile of blade B, and blade B is configured for being moved from the retracted position to the extended position using only one hand. By requiring locking bar L to be affirmatively and positively pulled upwardly to unlock blade B, the chances of accidental unlocking of the blade are minimized.

The same locking bar L and spring S mechanism, through engagement with retention profile 40, serve to prevent the blade from falling, or "flopping," out of the blade cavity of handle H when the blade is in the retracted position.

Additionally, the present invention provides a locking mechanism of reduced size and weight, as compared to certain prior art designs, and accordingly allows for a relatively large blade to be used with the same handle size as compared to conventional folding knife lock bar designs.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A folding knife, comprising:

an elongated handle having a forward portion and a forward end;

a blade connected to said forward portion of said handle, said blade having a pivotal blade connector and being connected for pivotal movement between a retracted position and an extended position; said blade having a first locking profile and a retention profile;

a locking member having a second locking profile, said second locking profile being configured to be in locking engagement with said first locking profile when said blade is in said extended position and in engagement with said retention profile of said blade when said blade is in said retracted position for selectively retaining said blade in said retracted position;

a pivotal connector connected to said handle and to said locking member for allowing said locking member to pivot with respect to said handle; said locking member being movable between a locking position, wherein said second locking profile is in locking engagement with said first locking profile for locking said blade in said extended position, and an unlocking position, wherein said blade is movable with respect to said handle; and a spring connected to said handle, between said forward end of said handle and said pivotal blade connector, and to said locking member, between said second locking profile and said pivotal connector, for pulling said locking member towards said locking position.

2. A folding knife, comprising:

an elongated handle having a forward portion and a forward end;

a blade connected to said forward portion of said handle, said blade having a pivotal blade connector and being connected for pivotal movement between a retracted position and an extended position; said blade having a first locking profile and a retention profile;

a locking member having a second locking profile, said second locking profile being configured to be in locking engagement with said first locking profile when said blade is in said extended position;

a pivotal connector connected to said handle and to said locking member for allowing said locking member to pivot with respect to said handle; said locking member being movable between a locking position, wherein said second locking profile is in locking engagement with said first locking profile for locking said blade in said extended position, and an unlocking position, wherein said blade is movable with respect to said handle; and a spring connected to said handle and to said locking member, between said pivotal connector and said forward end of said handle, for biasing said locking member towards said locking position.

3. A folding knife, comprising:

an elongated handle having a forward portion and a forward end adjacent said forward portion;

a blade having a pivotal blade connector connected to said forward portion of said handle for allowing said blade to pivot between a retracted position and an extended position;

a locking member having a pivotal connector connected to said handle and to said locking member for allowing said locking member to pivot with respect to said handle;

locking means for locking said locking member with said blade when said blade is in said extended position for retaining said blade in said extended position; and a spring connected to said handle between said pivotal blade connector and said forward end and to said locking member for biasing said locking member towards said extended position.

4. The folding knife as defined in claim 3, wherein said locking means includes a first locking profile defined on said blade and a second locking profile defined on said locking member, and wherein said second locking profile is in locking engagement with said first locking profile when said blade is in said extended position.

5. The folding knife as defined in claim 3, wherein:

said locking means includes a first locking profile defined on said blade and a second locking profile defined on said locking member;

said second locking profile is in locking engagement with said first locking profile when said blade is in said extended position; and said spring is connected to said locking member between said pivotal connector and said second locking profile.

6. A folding knife, comprising:

an elongated handle;

a blade connected to said handle, said blade being connected for movement between a retracted position and an extended position; said blade having a first locking profile;

a locking member having a second locking profile, said second locking profile being configured to be in locking engagement with said first locking profile when said blade is in said extended position;

a pivotal connector connected to said handle and to said locking member for allowing said locking member to pivot with respect to said handle; said locking member being movable between a locking position, wherein said second locking profile is in locking engagement with said first locking profile for locking said blade in said extended position, and an unlocking position, wherein said blade is movable with respect to said handle; and a spring connected to said locking member, between said second locking profile and said pivotal connector, and to said handle for biasing said locking member towards said locking position.

7. The folding knife as defined in claim 6, wherein said blade defines a tang portion and said first locking profile being adjacent said tang.

8. The folding knife as defined in claim 6, wherein said blade is pivotally connected to said handle by a pivotal blade connector and wherein said blade pivots between said extended and retracted positions.

9. The folding knife as defined in claim 6, wherein said handle has a forward end and a rearward end, and further comprising a pivotal blade connector connected to said handle and to said blade for allowing said blade to pivot between said extended and retracted positions; and wherein said spring is connected to said handle between said forward end and said pivotal blade connector.

10. The folding knife as defined in claim 6, wherein said first locking profile is a notch defined by said blade.

11. The folding knife as defined in claim 6, wherein said first locking profile is a projection on said blade.

12. The folding knife as defined in claim 6, wherein said first locking profile is an aperture defined by said blade.

13. The folding knife as defined in claim 6, wherein said second locking profile is a notch defined in said locking member.

14. The folding knife as defined in claim 6, wherein said second locking profile is a projection on said locking member.

15. The folding knife as defined in claim 6, wherein said second locking profile is an aperture defined by said locking member.

16. The folding knife as defined in claim 6, wherein said spring is a wire spring.

17. The folding knife as defined in claim 6, wherein said spring is a coil spring.

18. The folding knife as defined in claim 6, wherein said spring is a tension spring.

19. The folding knife as defined in claim 6, wherein said blade defines:

a tang portion;

said first locking profile adjacent said tang portion;

a retention profile for engagement by said locking member for selectively retaining said blade in said retracted position; and a guide profile extending between said first locking profile and said retention profile, upon which said locking member bears as said blade moves between said retracted and extended positions.

20. The folding knife as defined in claim 6, further comprising at least one projection on said locking member for engagement by the user to move said locking member between said locking position and said unlocking position.

21. A method of constructing a folding knife, comprising:

providing an elongated handle;

providing a blade having a first locking profile;

connecting said blade to said handle for movement between a retracted position and an extended position;

providing a locking member having a pivotal connector, said locking member having a second locking profile configured to be in locking engagement with said first locking profile when said blade is in said extended position;

connecting said pivotal connector to said handle for allowing said locking member to pivot with respect to said handle between a locking position, wherein said second locking profile is in locking engagement with said first locking profile for locking said blade in said extended position, and an unlocking position, wherein said blade is movable with respect to said handle;

providing a spring; and connecting said spring to said handle and to said locking member, between said second locking profile and said pivotal connector, for biasing said locking member towards said locking position.

22. The method as defined in claim 21, further comprising providing a pivotal blade connector connected to said blade and connecting said pivotal blade connector to said handle such that said blade pivots between said retracted and said extended positions.

23. The method as defined in claim 21, further comprising providing a pivotal blade connector connected to said blade and connecting said pivotal blade connector to said handle such that said blade pivots between said retracted position and said extended position, and wherein said spring is connected to said handle between one end of the handle and said pivotal blade connector.

* * * * *